US005719607A

United States Patent [19]

Hasegawa et al.

[11] Patent Number: 5,719,607

[45] Date of Patent: Feb. 17, 1998

[54] LIQUID JET HEAD

[75] Inventors: Kazumasa Hasegawa; Masato Shimada, both of Suwa, Japan

[73] Assignee: Seiko Epson Corporation, Tokyo-To, Japan

[21] Appl. No.: 518,653

[22] Filed: Aug. 24, 1995

[30] Foreign Application Priority Data

Aug. 25, 1994 [JP] Japan ..... 6-201086

[51] Int. Cl.[6] ..... B41J 2/045

[52] U.S. Cl. ..... 347/70; 216/27

[58] Field of Search ..... 347/54, 63, 65, 347/70; 216/27

[56] References Cited

U.S. PATENT DOCUMENTS

| | | | |
|---|---|---|---|
| 4,312,008 | 1/1982 | Taub et al. | 347/71 |
| 5,198,834 | 3/1993 | Childers et al. | 347/65 |
| 5,325,012 | 6/1994 | Sato | 310/364 |
| 5,491,505 | 2/1996 | Suzuki et al. | 347/56 |
| 5,530,465 | 6/1996 | Hasegawa et al. | 347/70 |
| 5,580,468 | 12/1996 | Fujikawa et al. | 216/27 |
| 5,637,126 | 6/1997 | Ema et al. | 216/27 |

FOREIGN PATENT DOCUMENTS 9322140 11/1993 WIPO .

OTHER PUBLICATIONS

K. Sameshima et al. "Preparation of PG . . . " Jpn. J. Appl. Phys. vol. 32 (1993) pp. 4144–4146.

*Primary Examiner*—Stuart N. Hecker
*Attorney, Agent, or Firm*—Ladas & Parry

[57] ABSTRACT

A highly reliable liquid jet head having excellent properties, comprising a silicon substrate, a tantalum layer having a thickness of 1,100 angstroms or more formed on the substrate, and a piezoelectric device provided on the tantalum layer, containing a layer of titanium oxide or of an oxide of titanium alloy between the tantalum layer and the electrode, or between the electrode and the piezoelectric film is obtained without suffering the formation of cavities in the silicon dioxide layer or the exfoliation between the electrode an a layer adjacent thereto.

17 Claims, 6 Drawing Sheets

LIQUID JET HEAD

BACKGROUND OF THE INVENTION

1. Field of the Invention

The present invention relates to a liquid jet head which can be suitably used for a liquid jet recording apparatus. In particular, the present invention relates to a liquid jet head utilizable as an ink jet recording head.

2. Background Art

A liquid jet recording apparatus, an ink jet printer being typical of it, is provided with a liquid jet head having a liquid supply system, a liquid chamber and a nozzle. When energy is applied to an ink composition filled in the liquid chamber, the ink is ejected from the liquid chamber through the nozzle. The ink composition thus ejected is deposited on a recording medium, whereby letters and images are recorded on the recording medium. As means for applying energy to the ink composition, there are generally known a means in which pressure is applied to the liquid chamber with a piezoelectric device, and a means in which the ink contained in the liquid chamber is heated by a heater.

A piezoelectric film in the piezoelectric device comprises, in general, a two-component system in which lead zirconate titanate (PZT) is a main component, or a three-component system composed of PZT and a third component added thereto.

Examples of a piezoelectric device which seems to be applicable to a liquid jet head include: a piezoelectric/electrostrictive film-type actuator disclosed in Japanese Laid-Open Patent Publication No. 12678/1992, in which a first electrode film, a piezoelectric film and a second electrode film are successively laminated to a ceramic substrate containing lead element; and a piezoelectric/electrostrictive film-type device disclosed in Japanese Laid-Open Patent Publication No. 97437/1993, composed of a thin ceramic substrate, and an electrode and a piezoelectric/electrostrictive layer which are provided on the ceramic substrate. In the case where a liquid jet head is prepared with the devise described in these Publications, the thinned portion of the substrate may be used as a vibrating diaphragm, and the space under it may be used as a liquid chamber as shown in Japanese Laid-Open Patent Publication No. 97437/1993.

However, since substrates of the devices disclosed in these Publications are ceramic, it is not easy to make, on the substrate, a thinned portion which is small in size and thickness. Therefore, it is difficult to densely provide nozzles in a liquid jet head so as to obtain an image with high resolution. Further, since ceramic substrates are expensive, these devices are not advantageous from the economic point of view.

Further, Japanese Laid-Open Patent Publication No. 47587/1993 discloses a thin film capacitor in which a first electrode made of a conductor containing silicon, a second electrode containing tantalum oxide, a platinum electrode, a dielectric substance film and an upper electrode are successively laminated to a substrate. Furthermore, Japanese Journal of Applied Physics Part I, 1993, Vol. 32, No. 9B, 4144–4146 discloses a device comprising a silicon dioxide layer, a tantalum layer having a thickness of 500 angstroms, a titanium layer having a thickness of 500 angstroms and a platinum layer having a thickness of 2,000 angstroms which are successively laminated to a single-crystal silicon substrate, and a piezoelectric film made of lead zirconate titanate (PZT), having a thickness of approximately 2,300 angstroms, formed on the platinum layer by the sol-gel method.

We tried to prepare liquid jet heads with the devices described in the above references. It was found that cavities were often formed in the silicon dioxide layer. In addition, exfoliation was sometimes observed between the electrode and the tantalum layer, or between the electrode and the piezoelectric film. By these, liquid jet heads are produced in decreased yield, and the reliability thereof is also impaired.

SUMMARY OF THE INVENTION

We have now found that the formation of cavities in the silicon dioxide layer can be prevented by controlling the thickness of the tantalum layer. Further, we have also found that the exfoliation between the electrode and a layer adjacent thereto can be prevented by interposing a specific layer between them.

Accordingly, an object of the present invention is to provide a liquid let head which is highly reliable and excellent in properties.

Another object of the present invention is to provide a method for producing a liquid jet head by which liquid jet heads can be produced in high yield.

According to an aspect of the present invention, there provides a liquid jet head for ejecting a liquid through a fine nozzle comprising:

a single-crystal silicon substrate provided with a liquid chamber in which a liquid to be ejected is preserved, a nozzle communicating with the liquid chamber, a vibrating diaphragm formed on the liquid chamber, a piezoelectric device formed on the vibrating diaphragm, the device comprising a piezoelectric film which comprises lead, and lower and upper electrodes by which the piezoelectric film is sandwiched, and a tantalum layer comprising tantalum oxide, provided between the vibrating diaphragm and the lower electrode; wherein the liquid in the liquid chamber is ejected outside through the nozzle by the change of the volume of the liquid chamber that is caused by deflection of the vibrating diaphragm according to driving of the piezoelectric device; and wherein the thickness of the piezoelectric film is 1 micrometer or more and that of the tantalum layer is 1,100 angstroms or more.

According to another aspect of the present invention, the liquid jet head of the present invention further comprises an intermediate layer provided between the tantalum layer and the lower electrode, or between the lower electrode and the piezoelectric film.

According to a further aspect of the present invention, there provides a method for preparing a silicon substrate having a piezoelectric device, for use in the above liquid jet head according to the present invention, the method comprising the steps of:

(a) forming a vibrating diaphragm on a single-crystal silicon substrate, (b) successively laminating a metallic tantalum layer, a lower electrode and the precursor of a piezoelectric film on the vibrating diaphragm, (c) heating the resulting single-crystal silicon substrate in an oxygen-containing atmosphere, thereby crystallizing the precursor of a piezoelectric film to form a piezoelectric film, and (d) forming an upper electrode on the piezoelectric film; wherein the thickness of the piezoelectric film and that of the tantalum layer after the step of heating the piezoelectric film is 1 micrometer or more and 1,100 angstroms or more, respectively.

According to a further aspect of the present invention, there provides a process for preparing a liquid jet head comprising the steps of:

removing silicon underneath the piezoelectric film from the silicon substrate obtained by the above method of the present invention, thereby forming a chamber which will be a liquid chamber, and joining the silicon substrate having the chamber to a second substrate, thereby closing the chamber to form the liquid chamber, and allowing both a nozzle and a liquid supply system which supplies liquid to the liquid chamber to communicate with the liquid chamber.

DETAILED DESCRIPTION OF THE INVENTION

Liquid Jet Head

Figure 1:
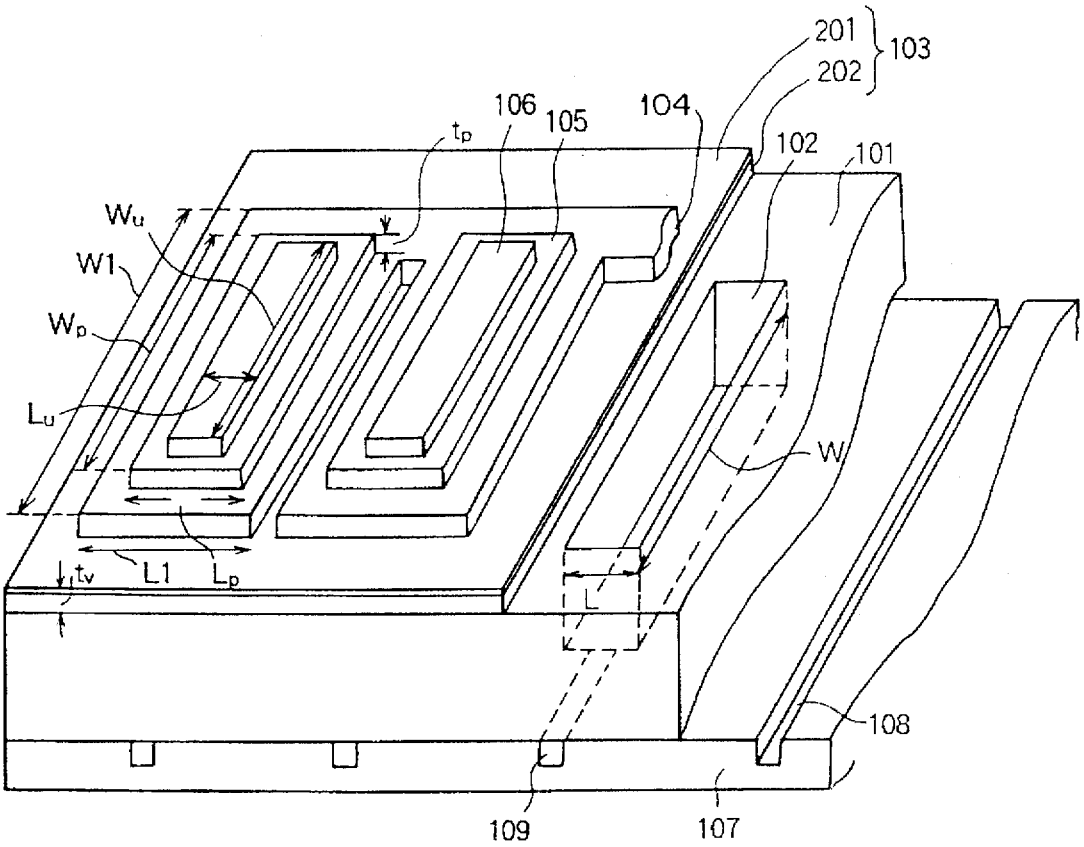
FIG. 1 is a perspective view of a liquid jet head according to the present invention.

Referring now to the accompanying drawings, the liquid jet head according to the present invention will be explained in detail. It should be noted that the thicknesses and areas of the films and layers shown in the drawings are those which are enlarged or reduced accordingly for explanation, so that the ratio between their thicknesses or areas is inaccurate.

FIG. 1 is a perspective view of the liquid jet head according to an embodiment of the present invention. In a first substrate 101 made of single-crystal silicon, a camber which will be a liquid chamber 102 is provided. On the liquid chamber 102 is formed a vibrating diaphragm 103 which comprises a silicon oxide layer 201 and a main vibrating diaphragm 202. A tantalum layer 203 comprising tantalum oxide is formed on the vibrating diaphragm 103. A piezoelectric device which comprises a lower electrode 104, a piezoelectric film 105 and an upper electrode 106 is provided on the tantalum layer 203. The first substrate 101 is joined on to a second substrate 107 in which a liquid channel 108 is formed. At the border, an opening 109 which will serve as a nozzle is formed so that it can communicate with the liquid chamber 102 through the liquid channel 108.

Figure 2:
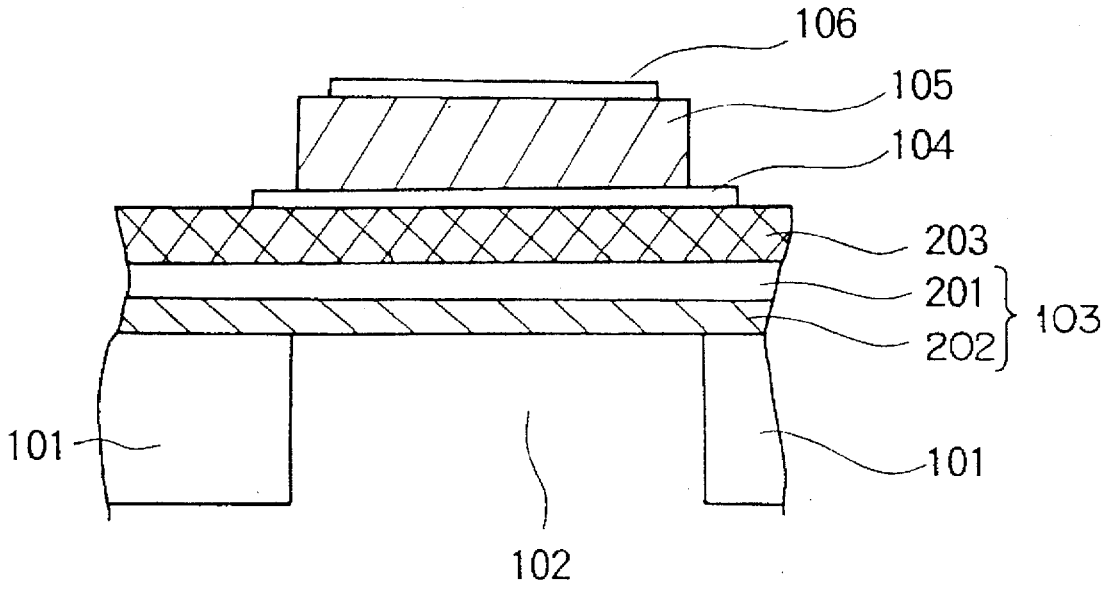
FIG. 2 is an enlarged cross-sectional view showing the laminar structure of the liquid jet head according to the present invention.

FIG. 2 shows the enlarged cross-sectional view of the liquid jet head shown in FIG. 1, comprising the first substrate 101 and the layers provided thereon.

The liquid jet head works as follows. When voltage is applied between the lower electrode 104 and the upper electrode 106, the piezoelectric device composed of the lower electrode 104, the piezoelectric film 105 and the upper electrode 106, and the vibrating diaphragm 103 are deformed and deflected, so that the volume of the liquid chamber 102 is decreased. As a result, the liquid filled in the liquid chamber 102 is pushed forward into the liquid channel 108, and then ejected outside through the nozzle 109.

In the present invention, the piezoelectric film 105 is a piezoelectric film comprising lead, having a thickness of 1 micrometer or more, preferably in the range of 1 to 5 micrometers. Further, in the present invention, the tantalum layer 203 has a thickness of 1,100 angstroms or more, preferably about 1,200 to 10,000 angstroms, more preferably 1,200 to 3,000 angstroms. By making the thickness of the piezoelectric film to 1 micrometer or more, there can be obtained a liquid jet head which can eject liquid in high density. For example, the liquid head of the present invention can produce an image with high resolution (for example, 360 dpi or more) in the ink jet recording method. Furthermore, we found that the formation of cavities in the silicon oxide layer 201 can be effectively prevented when the thickness of the tantalum layer 203 is adjusted to 1100 angstroms or more.

In the present invention, a piezoelectric film comprising 18 atomic % or more, preferably 20 atomic % or more of lead is preferable as the piezoelectric film comprising lead. Preferable examples of the piezoelectric film include a film comprising lead titanate, and a film of the so-called two-component system whose main component is lead zirconate titanate (PZT). More preferable specific examples of the piezoelectric film include those which have a composition represented by the following formula:

$$Pb(Zr_XTi_{1-X})O_3+YPbO$$

wherein X and Y are $0.40 \leqq X \leqq 0.6$ and $0 \leqq Y \leqq 0.3$, respectively.

Further, the thin film piezoelectric device according to the present invention may have a piezoelectric film of the so-called three-component system which is obtained by further adding a third component (for example, lead magnesium niobate) to the PZT. Preferable specific examples of the three-component system include those represented by the following formula:

$$PbTi_aZr_b(A_gB_h)_cO_3+ePbO+(fMgO)_n$$

wherein

A represents a divalent metal selected from the group consisting of Mg, Co, Zn, Cd, Mn and Ni, or a trivalent metal selected from the group consisting of Sb, Y, Fe, Sc, Yb, Lu, In and Cr;

B represents a quinquevalent metal selected from the group consisting of Nb, Ta and Sb, or a sexivalent metal selected from the group consisting of W and Te; and a to h fulfill the following conditions:

$a+b+c=1$, $0.35 \leqq a \leqq 0.55$, $0.25 \leqq b \leqq 0.55$, $0.1 \leqq c \leqq 0.4$, $0 \leqq e \leqq 0.3$, $0 \leqq f \leqq 0.15c$, $g=h=1/2$ and $n=0$, provided that when A represents a trivalent metal, B does not represent a sexivalent metal, that when A represents a divalent metal and B represents a quinquevalent metal, g is ⅓ and h is ⅔, and that only when A represents Mg and B represents Nb, n is 1.

More preferable specific example of the three-component system is one in which A represents Mg, B represents Nb, g is ⅓ and h is ⅔.

Even in the above compositions, Pb content is preferably 18 atomic % or more, more preferably 20 atomic % or more of the composition as mentioned previously.

If MgO is in the above range when A represents Mg and B represents Nb, the evaporation of PbO can be prevented throughout the heat treatment, and reaction between the piezoelectric film and the Si substrate can also be prevented. Moreover, the existence of MgO contributes to the stabilization of the perovskite phase by which the piezoelectric properties are improved.

In order to improve the piezoelectric properties, an extremely small amount of Ba, Sr, La, Nd, Nb, Ta, Sb, Bi, W, Mo, Ca or the like may also be incorporated into the piezoelectric film of either the two-component system or the three-component system. In particular, in the case of the three-component system, the incorporation of 0.10 mol % or less of Sr or Ba is favorable to improve the piezoelectric properties. Further, in the case of the three-component system, the addition of 0.10 mol % or less of Mn or Ni is also favorable because it can enhance the degree of sintering of the piezoelectric film.

In the present invention, preferable examples of the vibrating diaphragm 103 comprises silicon or a silicon compound. In the embodiment shown in FIG. 1, the vibrating diaphragm 103 is composed of the silicon oxide layer 201 and the main vibrating diaphragm 202. The preferred examples of the main vibrating diaphragm 202 include those layers which are obtained by doping boron into silicon. The amount of boron to be doped is preferably about $5\times10^{19}$ to $5\times10^{20}$ $cm^{-3}$. The thickness of the vibrating diaphragm is preferably about 0.2 to 3 micrometers, more preferably about 0.5 to 1 micrometers. The vibrating diaphragm may be made of zirconia, alumina or zirconium nitride. Further, the vibrating diaphragm may be a laminate consisting of the layers of these materials on a silicon or silicon compound layer.

The thickness of the silicon oxide layer 201 is preferably about 1.0 micrometers or less, more preferably about 0.5 micrometers or less.

It is preferable that the tantalum layer 203 comprising tantalum oxide be a layer in which a crystal phase of tantalum oxide and that of an oxide represented by the composition formula $TaPb_YO_X$ are present as a mixture. The tantalum oxide may be tantalum dioxide, tantalum pentoxide, or a mixture thereof. Tantalum pentoxide is preferred. As will be described later, it is preferable that the tantalum layer be formed as a metallic tantalum layer before the precursor of a piezoelectric film is subjected to sintering. When the precursor is sintered in an oxygen-containing atmosphere, the metallic tantalum is oxidized, and converted into both tantalum oxide and an oxide represented by the formula $TaPb_YO_X$ due to lead diffused from the precursor of a piezoelectric film. The thickness of the tantalum layer is increased in the course of this step of sintering. In the present invention, the thickness of the tantalum layer, which is 1100 angstroms or more, is that of the tantalum layer after the crystallization of the precursor of a piezoelectric film is completed. The previously-mentioned formation of cavities in the silicon dioxide layer can be effectively prevented by providing a tantalum layer of which thickness after the crystallization of the precursor is 1100 angstroms or more. The reason for this can be considered as follows, but it is not intended to be limiting the present invention. According to our studies on the process of the formation of cavities in the silicon oxide layer, it is presumed that when lead which is diffused from the precursor of a piezoelectric film during the step of the crystallization thereof penetrates into the silicon oxide layer, the melting point of the silicon oxide is lowered. The liquefied silicon oxide gushes out to form cavities in the silicon oxide layer. On the other hand, it was found that when a tantalum layer having at least a specific thickness is provided, the diffusion of lead can be obstructed by the tantalum layer. Thus, the lead can be prevented from reaching the silicon oxide layer. It is considered that even if lead penetrates into the silicon oxide layer, cavities cannot be produced as long as the melting point of the silicon oxide is not lowered to the crystallization temperature or lower. Therefore, it is not necessary that the penetration of lead into the silicon oxide layer be perfectly prevented by the tantalum layer. However, in order to obtain a piezoelectric film having good properties, it is preferable to crystallize the precursor of a piezoelectric film at temperatures elevated to a certain degree. It is therefore preferable to prevent lead from penetrating into the silicon oxide layer as much as possible, and it is, in general, preferable to make the tantalum layer thick within such a range that the layer does not impair the properties of the liquid jet head. The preferable thickness of the tantalum layer is as described above.

Those materials which have been ordinarily used for the electrodes of conventional piezoelectric devices can be used for the lower electrode 104 and the upper electrode 106. For example, platinum, a platinum alloy or gold can be favorably used for the electrodes. The thickness of the lower electrode and that of the upper electrode can be suitably selected. However, they are preferably in the range of approximately 0.05 to 2 micrometers.

Figure 3:
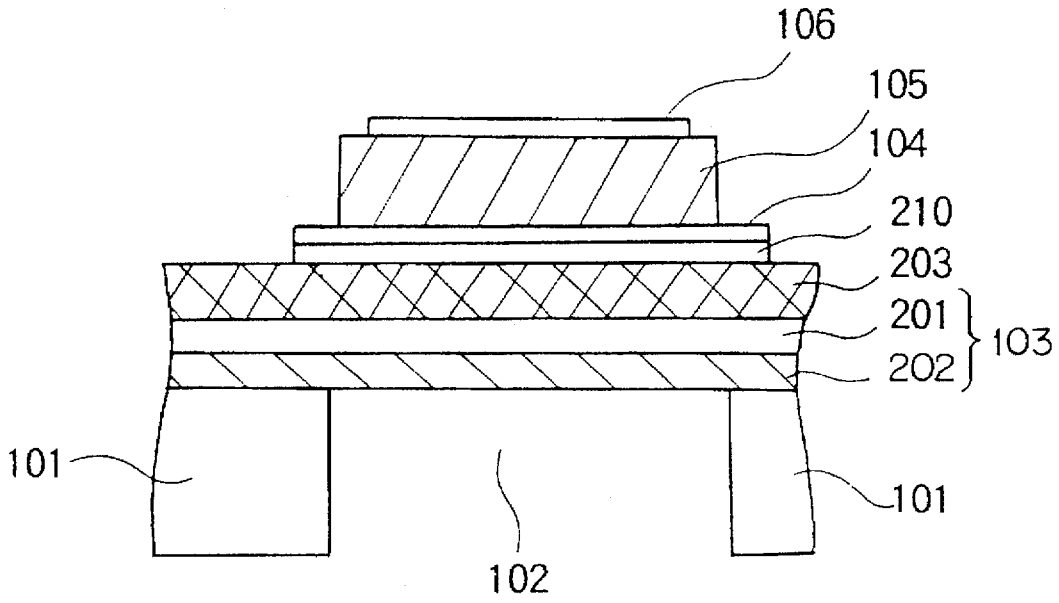
FIG. 3 is an enlarged cross-sectional view showing the laminar structure of the liquid jet head in which a first intermediate layer is further provided between the tantalum layer and the lower electrode so as to improve the adhesion between them.

According to the preferred embodiment of the present invention, a first intermediate layer is provided between the lower electrode and the tantalum layer. By providing the first intermediate layer, the adhesion between the lower electrode and the tantalum layer can be improved. The exfoliation between the lower electrode and the tantalum layer can thus be effectively prevented. The enlarged cross-sectional view of the liquid jet head provided with the first intermediate layer is as shown in FIG. 3, in which the first intermediate layer is a layer indicated by reference numeral 210. According to the preferred embodiment of the present invention, the first intermediate layer comprises titanium oxide, chromium oxide, nickel oxide or tungsten oxide. Further, according to another preferred embodiment of the present invention, the first intermediate layer comprises an oxide of an alloy of tantalum and a metal of the platinum group or titanium. The platinum group herein includes ruthenium, rhodium, palladium, osmium, iridium and platinum. Of these, platinum is preferred. The ratio of tantalum to platinum in an alloy thereof is preferably about 80:20 to 5:95. In the case where the lower electrode is made of platinum, an alloy of tantalum and platinum (tantalum: platinum=about 30:70) is one of the most preferable materials for the first intermediate layer when the improvement of the adhesion between the lower electrode and the tantalum layer is taken into consideration.

In this disclosure, the expression "a layer comprising a certain metal" includes not only a case where the metal itself exists as a layer but also a case where the metal exists without forming a definite layer, that is, the metal is dispersed in the layer or penetrated also into neighboring layers. Therefore, there may be a case where the thickness of the first intermediate layer cannot be clearly defined. However, the thickness of the first intermediate layer is preferably 500 angstroms or less, more preferably about 50 to 200 angstroms.

Figure 4:
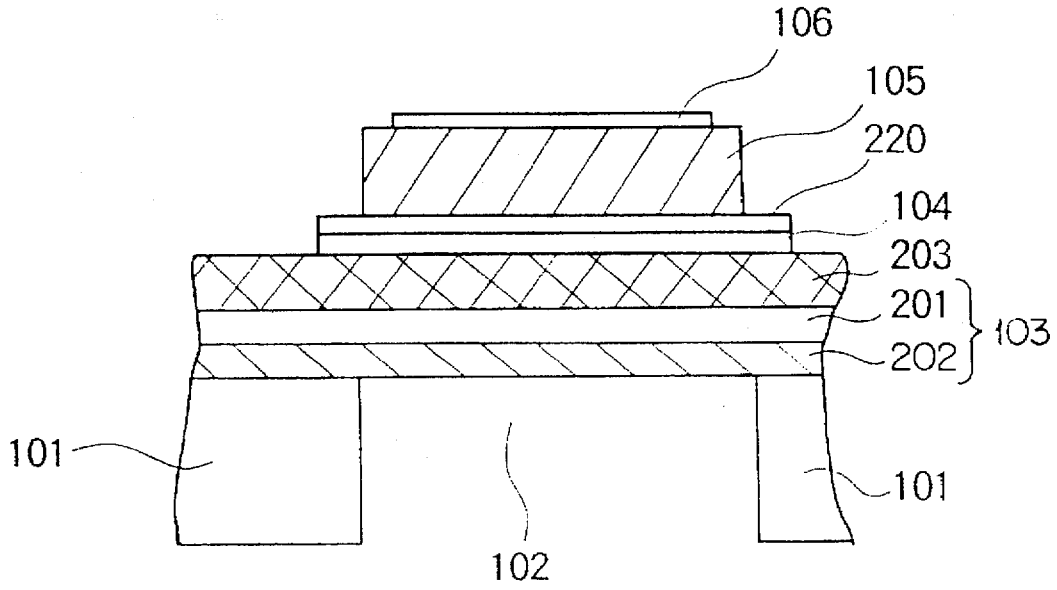
FIG. 4 is an enlarged cross-sectional view showing the laminar structure of the liquid jet head in which a second intermediate layer is further provided between the lower electrode and the piezoelectric film so as to improve the adhesion between them.

Further, according to the preferred embodiment of the present invention, a second intermediate layer is provided between the lower electrode and the piezoelectric film. By providing this second intermediate layer, the adhesion between the lower electrode and the piezoelectric film can be improved. The exfoliation between the lower electrode and the piezoelectric film can thus be effectively prevented. The enlarged cross-sectional view of the liquid jet head provided with the second intermediate layer is as shown in FIG. 4, in which the second intermediate layer is a layer indicated by reference numeral 220. It is noted that both the first intermediate layer 210 and the second intermediate layer 220 can be provided, and a liquid jet head provided with these two intermediate layers is also included in the present invention. According to the preferred embodiment of the present invention, the second intermediate layer comprises titanium oxide. According to another preferred embodiment of the present invention, the second intermediate layer comprises an oxide of an alloy of a metal selected from tantalum, nickel and metals of the platinum group, with titanium. The meaning of the expression "a layer comprising a certain metal" as described above also applies to the second intermediate layer. Thus, in the second intermediate layer, there may be a case where the thickness thereof cannot be clearly defined. However, the thickness of the second intermediate layer before the precursor of a piezoelectric film is crystallized in the production process, which will be described later, is preferably 150 angstroms or less, more preferably about 50 to 100 angstroms.

Figure 5:
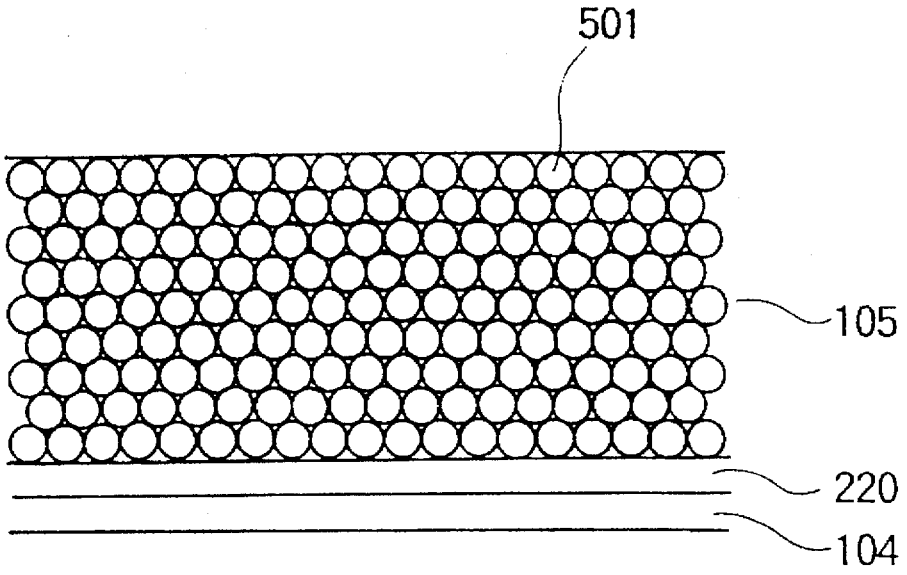
FIG. 5(*a*) is a diagrammatic sectional view showing that the piezoelectric film is composed of spherical uniform crystal grains which are formed because a second intermediate layer is provided, and FIG. 5(*b*) is a diagrammatic sectional view showing that the piezoelectric film is composed of columnar crystal grains which are produced in a certain range from the interface with the lower electrode because a second intermediate layer is not provided, and spherical crystal grains formed thereon.
Figure 5:
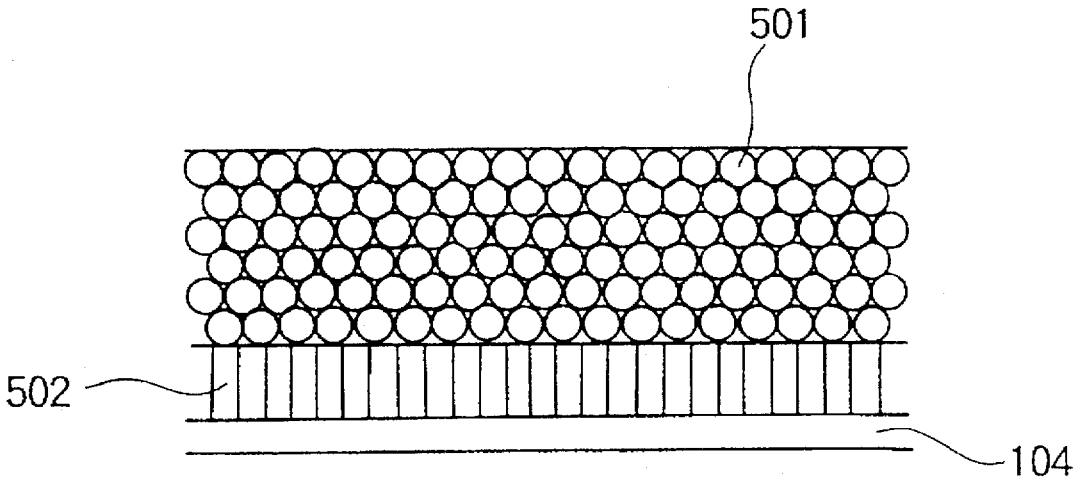

The improvement of the adhesion between the lower electrode and the piezoelectric film is not the only one result attained by providing the second intermediate layer. It was unexpectedly found that when the second intermediate layer is provided, the piezoelectric film becomes to be composed of spherical uniform crystal grains. In addition, the electrostriction constant d31 of the piezoelectric device in the liquid jet head according to the present invention was also found to be improved. FIG. 5(*a*) is an enlarged diagrammatic cross-sectional view showing the crystalline structure of the piezoelectric film in the liquid jet head according to the present invention. The piezoelectric film 105 is composed of spherical uniform crystal grains 501 which are formed from the interface with the second intermediate layer 220. On the other hand, FIG. 5(*b*) is an enlarged diagrammatic cross-sectional view showing the crystalline structure of the piezoelectric film in the liquid jet head which is not provided with the second intermediate layer 220. In this case, the piezoelectric film 105 is composed of columnar crystal grains 502 having a certain thickness, formed on the interface with the lower electrode 104, and spherical crystal grains 501 formed on the columnar crystal grains.

Figure 6:
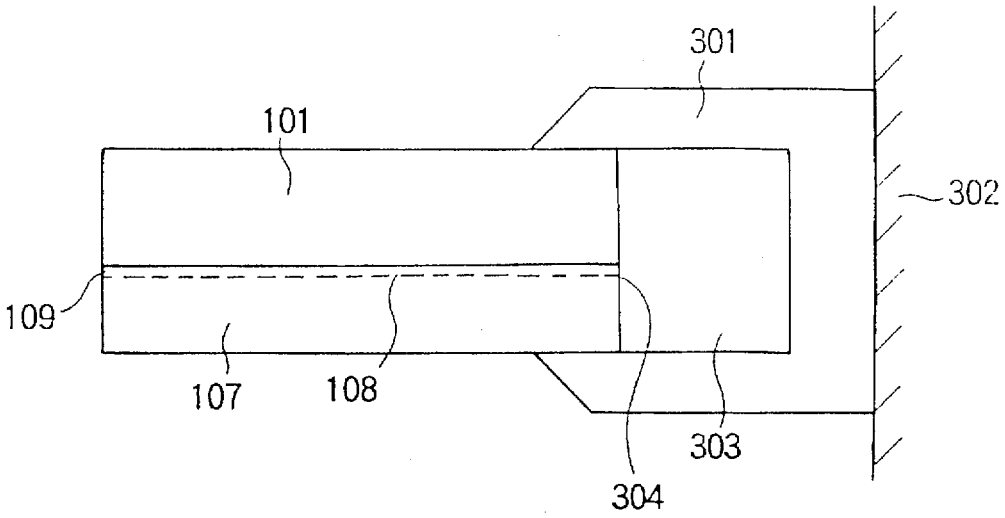
FIG. 6 is an illustration showing an embodiment of the practical use of the liquid jet head according to the present invention.

An embodiment of the use of the liquid jet head according to the present invention is, for example, as follows. FIG. 6 is a general view showing the structure of the liquid jet head of the present invention upon practical use. The first substrate 101 provided with the piezoelectric device and the liquid chamber is joined on to the second substrate 107 in which the liquid channel 108 is formed, and a nozzle 109 and a liquid-introducing hole 304 are formed. A liquid reservoir 303 is formed by enclosing the liquid-introducing hole side of the liquid jet head with a substrate 301. A liquid is supplied, from outside, to this liquid reservoir 303. The substrate 301 is attached to a mounting substrate 302.

Figure 7A:
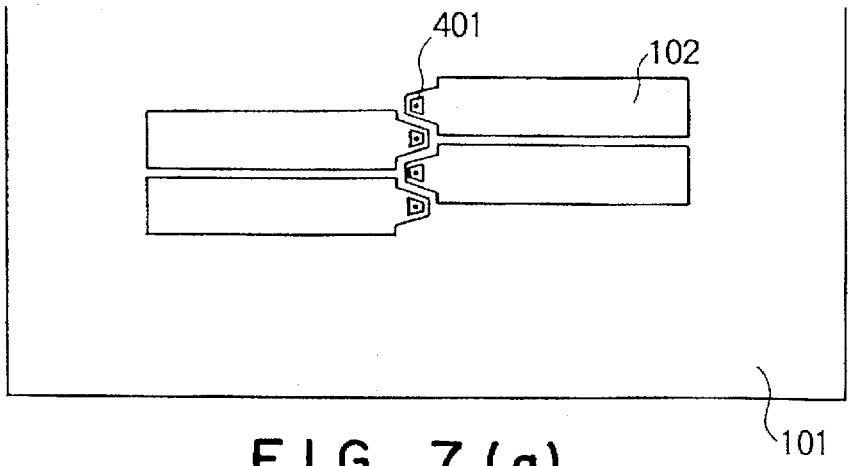
FIGS. 7(*a*) and 7(*b*) are an illustration showing another embodiment of the practical use of the liquid jet head according to the present invention.
Figure 7B:
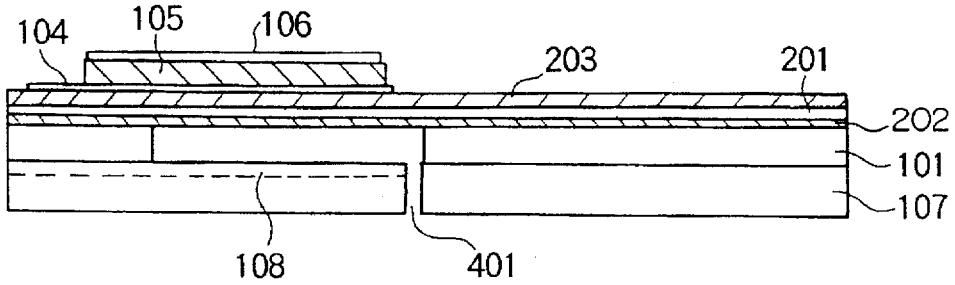

FIGS. 7(*a*) and 7(*b*) are a plane view and a cross-sectional view of the liquid jet head according to the present invention upon practical use. After a nozzle 401 is formed in the second substrate 107 which has been provided with the liquid channel 108, the first substrate 101 is joined on to the second substrate to give the liquid jet head shown in the figures. It is therefore possible to arrange the liquid chambers 102 in a staggered form and the nozzles 401 in a straight line as shown in FIG. 7(*a*). In this embodiment, the pitch of arranging the nozzles 401 can be made half of that of arranging the liquid chambers 102. When the size of the liquid chamber is made to 100 micrometers, it becomes possible to arrange the nozzles in a density of approximately 400 dip. Thus, the nozzles can be arranged in a higher density. The liquid jet head of the present invention shown is thus advantageous from this point of view.

Preparation of Liquid Jet Head

Figure 8A:
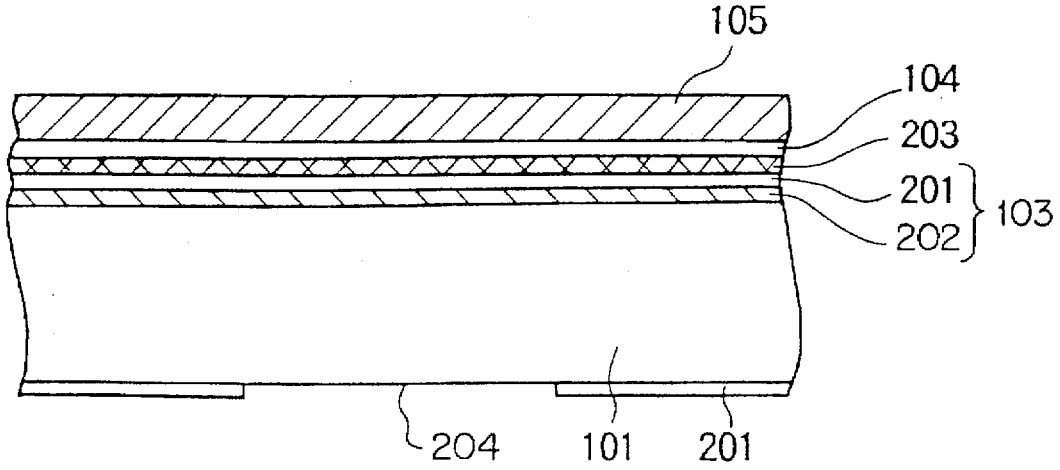
FIGS. 8(*a*), 8(*b*) and 8(*c*) include illustrations explaining the method for producing the first substrate of the liquid jet head according to the present invention, in which FIG. 8(*a*) is an illustration showing a silicon substrate on which a main vibrating diaphragm, a silicon oxide layer, a tantalum layer, a lower electrode and a piezoelectric film are formed, FIG. 8(*b*) is an illustration showing the state after the lower electrode, the piezoelectric film and an upper electrode are subjected to patterning, and FIG. 8(*c*) is an illustration showing the state after a space which will be a liquid chamber is formed in the substrate and the piezoelectric device part is covered with a protective film.
Figure 8B:
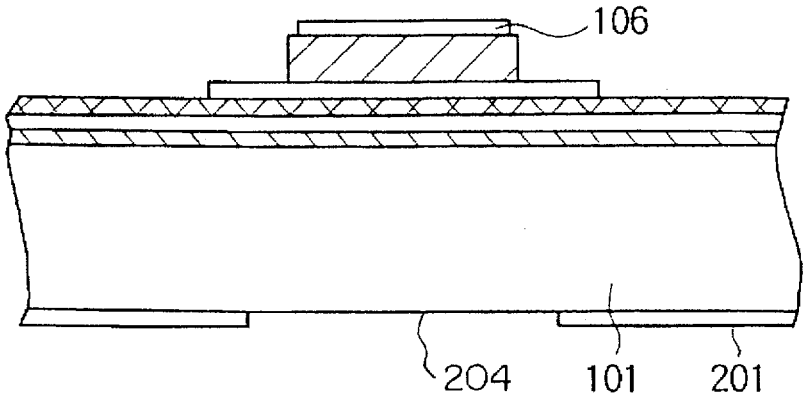
Figure 8C:
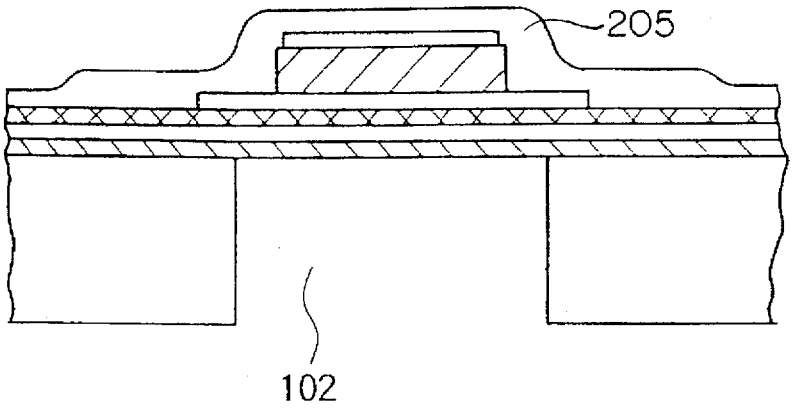

The method for preparing a liquid jet head according to the present invention will now be explained. FIGS. 8(*a*), 8(*b*) and 8(*c*) are cross-sectional views showing the steps of forming the piezoelectric device on and the liquid chamber in the first substrate 101. It is noted that in these cross-sectional views, the direction vertical to the surface of the paper is the direction of the length of the liquid chamber.

A first substrate 101 made of single-crystal silicon is thermally oxidized by heating it to a temperature of approximately 1,100° to 1,200° C., thereby forming a silicon oxide layer 201 having a thickness of approximately 3,000 to 5,000 angstroms on both surfaces of the substrate 101. From one surface of the substrate 101, boron is allowed to diffuse to the lower part of the silicon oxide layer 201 at a temperature of 1,000° C. to form the main vibrating diaphragm 202. A photoresist film is formed on both surfaces of the resulting substrate 101, and an opening is provided on the surface of the substrate opposite to the vibrating diaphragm side. By treating the silicon oxide layer 201 with hydrofluoric acid and an aqueous ammonium fluoride solution to form an opening 204.

On the silicon oxide layer 201 formed of the first substrate 101, a tantalum layer 203, a lower electrode 104, a piezoelectric film 105, and, if necessary, a first intermediate layer 210 and a second intermediate layer 220 are formed. These layers can be formed by utilizing any of various means ordinarily used for forming a thin layer. Preferable means for forming the layers include the sputtering method, the chemical vapor deposition (CVD) method and the sol-gel method.

The first intermediate layer may be made as a metallic layer, i.e., a layer of an alloy of tantalum and a metal of the platinum group or titanium; or a metallic titanium, chromium, nickel or tungsten. During the step of sintering a precursor of a piezoelectric film, the metallic layer is oxidized to be an oxide of the alloy of tantalum and a metal of the platinum group or titanium; or titanium oxide, chromium oxide, nickel oxide or tungsten oxide. At the same time, the thickness of the first intermediate layer is increased. Therefore, the thickness of the metallic layer as the first intermediate layer may be determined so that the final thickness of the first intermediate layer is in the range as described above. The metallic layer of titanium, chromium, nickel or tungsten having a thickness of 50 to 200 angstroms gives the fist intermediate layer having 500 angstroms or less after the step of sintering a precursor of a piezoelectric film. On the other hand, the first intermediate layer made of titanium oxide, chromium oxide, nickel oxide or tungsten oxide does not change the thickness during the step of sintering a precursor of a piezoelectric film. Therefore, the first intermediate layer made of these oxides may have a thickness of 500 angstroms or less before the step of sintering a precursor of a piezoelectric film.

Further, in the case where the layer to be formed is an alloy layer, the alloy layer can be formed by the multi-element simultaneous sputtering method, or by a sputtering method in which an alloy having the desired composition is used as a target. Furthermore, a tantalum-platinum alloy layer containing oxygen can be directly formed in an oxygen-containing atmosphere by the reactive sputtering method.

It is preferable that the piezoelectric film be formed in the following manner.

Firstly, the amorphous precursor of a piezoelectric film is formed on the electrode film (or on the second intermediate layer) by means of sputtering, using as a target a sintered PZT body containing specific components.

The amorphous precursor is crystallized and sintered by heating. It is preferable to conduct this heating treatment in two steps in an oxygenic atmosphere (for example, in an atmosphere of oxygen, or of a mixed gas of oxygen and an inert gas such as argon). In the first heating step, the amorphous precursor is crystallized; and in the second heating step, the crystal grains produced are allowed to grow, and sintering between the crystal grains is promoted. Specifically, in the first heating step, the precursor film is heated at a temperature of preferably from 500° to 700° C. in an oxygenic atmosphere. The precursor film is thus crystallized by heating. This first heating step can be terminated when the precursor film is uniformly crystallized. Subsequently, in the second heating step, the crystallized film is heated at a temperature of 750° to 1100° C.

The first and second heating steps can be conducted continuously. Alternatively, after the precursor film heated in the first heating step is cooled to room temperature, the second heating step is conducted.

The structure shown in FIG. 8(*a*) can thus be obtained.

The piezoelectric film 105 thus formed is treated with an aqueous borofluoric acid solution, and the lower electrode 104 is treated with aqua regia, thereby removing the unwanted part thereof. Thereafter, an upper electrode 106 is further provided on top of the piezoelectric film 105 to obtain a piezoelectric device. As a result, the structure of the substrate becomes to one shown in FIG. 8(*b*).

On the piezoelectric device formed on the substrate, a protective film 205 is formed by using, for example, a photosensitive resin. If desired, a part of the protective film can be removed so as to form a takeoff connection for the electrode.

A liquid chamber 102 is formed in the substrate covered with the protective film 205, for example, in the following manner: the silicon substrate 101 is dipped in a solution in which the substrate is soluble, for example, an aqueous potassium hydroxide solution, and the single-crystal silicon substrate 101 is etched from the opening 204 provided on the silicon oxide layer 201. The silicon oxide layer 201 is removed by means of etching, using hydrofluoric acid and an aqueous ammonium fluoride solution, thereby obtaining a first substrate whose structure is as shown in FIG. 8(*c*).

The first substrate thus obtained is joined on to the second substrate 107 in which the liquid channel 108 is provided as shown in FIG. 1, thereby obtaining a liquid jet head.

In the production of the liquid jet head, it is preferable that the direction of the crystal face in the first substrate made of single-crystal silicon be taken into consideration. A technique disclosed in WO 93/22140 is preferably used.

The present invention will now be explained more specifically by referring to the following examples. However, the present invention is not limited by these examples.

In the following examples, the dimensions indicated in FIG. 1 are as follows, unless otherwise indicated: in the liquid chamber 102, L is 100 micrometers and W is 15 mm; in the lower electrode 104, L1 is 118 micrometers and W1 is 17 mm; in the piezoelectric film 105, Lp is 88 micrometers and Wp is 16 mm; and in the upper electrode 106, Lu is 82 micrometers and Wu is 15.8 mm. Further, the section of the liquid channel 108 is a 40 micrometers square.

EXAMPLE 1

A substrate made of single-crystal silicon of (110) is thermally oxidized at 1,100° C. to form a silicon oxide layer having a thickness of 5000 angstroms on both surfaces of the substrate. From one surface of the substrate, boron is allowed to diffuse to the lower part of the silicon oxide layer at 1,000° C., thereby forming a vibrating diaphragm. The thickness of the main vibrating diaphragm was 1 micrometer, and the concentration of boron was $10^{20}$ $cm^{-3}$.

A photoresist layer was then formed on both surfaces of the substrate. The photoresist layer formed on the surface opposite to the vibrating diaphragm side was removed, and the silicon oxide layer was etched by using hydrofluoric acid and an aqueous ammonium fluoride solution to form an opening. The direction of the length of the opening, i.e., the direction vertical to the surface of the paper is defined as the direction $<1\bar{1}2>$ or $<\bar{1}12>$. After the photoresist layer was removed, a tantalum layer, a first intermediate layer, a lower electrode and a piezoelectric film were successively laminated, in the following manner, on the vibrating diaphragm side of the substrate. Specifically, a metallic tantalum layer having a thickness of 200, 500, 600 or 1,000 angstroms was formed by means of sputtering on the silicon oxide layer on the vibrating diaphragm side. Thereafter, a titanium layer having a thickness of 50 angstroms and a platinum layer having a thickness of 2,000 angstroms were successively formed on the tantalum layer.

By using as a target a sintered body whose composition is represented by the following formula:

$$Pb_{0.95}Sr_{0.05}Zr_{0.28}Ti_{0.35}Mg_{0.123}Nb_{0.247}O_3 \text{ (90 mol \%)} + PbO \text{ (10 mol \%)},$$

high-frequency sputtering was conducted in an atmosphere of argon without heating the substrate. The precursor of a piezoelectric film having a thickness of 3 micrometers was thus formed on the substrate. The substrate on which the precursor was formed was sintered at 650° C. for one hour and at 900° C. for one hour in an oxygenic atmosphere. After the sintering was completed, the piezoelectric film and the lower electrode were etched by using an aqueous borofluoric acid solution and aqua regia, respectively, thereby conducting patterning.

On the piezoelectric film, a titanium layer having a thickness of 50 angstroms and a gold layer having a thickness of 2,000 angstroms were successively formed by means of sputtering as adhesion layer and the upper electrode, respectively. The patterning of these layers was conducted by etching, using an aqueous iodine solution and an aqueous potassium iodide solution.

On the surface of the substrate on which the piezoelectric device was formed, a protective film having a thickness of 2 micrometers was formed by using a photosensitive polyimide, and a part of the protective film was removed by development to form a takeoff connection for the electrode, followed by thermal treatment at 400° C.

The substrate was dipped in an aqueous potassium hydroxide solution with its surface on the side of the piezoelectric device covered with the protective film protected by a jig. Anisotropic etching of the single-crystal silicon substrate was conducted from the opening on the silicon oxide layer to form a liquid chamber. The direction of the crystal face in the single-crystal silicon substrate is (110), and the direction of the length of the opening is defined as the direction <1$\bar{1}$2> or <$\bar{1}$12>. Therefore, the surface of the side wall forming the side in the direction of the length of the liquid chamber can be made to (111). When an aqueous potassium hydroxide solution is used for etching, the ratio of the etching rate of the face (110) to that of the face (111) in the single-crystal silicon is approximately 300:1. Therefore, a groove having a depth of 300 micrometers was able to be formed with the side etching controlled to approximately 1 micrometer. Keeping the substrate fixed to the jig, the silicon oxide layer, which was in contact with the substrate, was removed by etching, using hydrofluoric acid and an aqueous ammonium fluoride solution. Thus, first substrates were obtained.

The broken-out sections of the first substrates thus obtained were observed by a scanning electron microscope to determine the thickness of the tantalum layer and to examine whether cavities were formed in the silicon oxide layer or not. The results were as shown in the following Table 1.

TABLE 1

| Thickness of Tantalum Layer (Å) | | |
|---|---|---|
| Before Sintered | After Sintered | Cavities in $SiO_2$ Layer |
| 200 | 420 | found |
| 500 | 1,000 | found |
| 600 | 1,200 | not found |
| 1,000 | 2,100 | not found |

The piezoelectric film was subjected to component analysis using an EPMA. As a result, it was found that the lead content of the piezoelectric film was 18 atomic %. Further, the piezoelectric film was analyzed by the X-ray diffraction method. It was thus confirmed that metallic tantalum did not exist in the piezoelectric film and that a crystal phase of tantalum pentoxide and that of tantalum pentoxide-lead oxide compound were present as a mixture.

The first substrate having the tantalum layer having a thickness of 600 or 1000 angstroms thus obtained was adhered to a second substrate obtained which was prepared by a plastic injection mold and had a liquid channel integrally molded therewith, whereby liquid jet heads were obtained. A liquid jet test was carried out by the use of these liquid jet heads. An aqueous ink composition was used as the liquid, and 15 V was applied to the piezoelectric film. In either liquid jet head, the jet velocity of the liquid at the point 5 mm from the nozzles was found to be 15 m/sec.

EXAMPLE 2

First substrates were prepared in the same manner as in Example 1 except that the thickness of the titanium layer which was formed on the tantalum layer before the crystallization of the precursor of a piezoelectric film was changed. The broken-out sections of the first substrates obtained were observed by a scanning electron microscope with respect to exfoliation between the titanium layer and the platinum layer serving as the lower electrode, and to roughness on the surface of the piezoelectric film. The results were as shown in the following Table 2.

TABLE 2

| Thickness of Ti Layer (Å) | | | Roughness on |
|---|---|---|---|
| Before Sintered | After Sintered | Exfoliation | PZT film |
| 50 | 100 | not found | not found |
| 200 | 500 | not found | not found |
| 500 | 1,000 | not found | found |
| 1,000 | 1,800 | not found | found |

EXAMPLE 3

A first substrate was prepared in the same manner as in Example 1 except that a first intermediate layer made of an alloy of tantalum and platinum (tantalum:platinum= approximately 50:50), having a thickness of 500 angstroms and a lower electrode made of platinum, having a thickness of 2000 angstroms were laminated to a tantalum layer having a thickness of 1000 angstroms. The tantalum-platinum alloy layer was formed by alternately laminating a platinum layer of 50 angstroms and a tantalum layer of 50 angstroms by means of sputtering. The surface of the piezoelectric film was observed by a 200× metallurgical microscope, and the broken-out section of the substrate was observed by a scanning electron microscope. As a result, exfoliation between the layers, roughness on the surface of the piezoelectric film and the formation of cavities in the silicon oxide layer were not found.

EXAMPLE 4

The first substrate was prepared in the same manner as in Example 1 except that a titanium layer having a thickness of 50 angstroms and a platinum layer having a thickness of 2,000 angstroms were formed as the first intermediate layer and the lower electrode 104, respectively, and that a titanium layer having a thickness of 50 angstroms was further formed on the platinum layer as the second intermediate layer. The substrate thus obtained was analyzed by the X-ray diffraction method. Diffracted ray from titanium dioxide crystals was observed at the part corresponding to the second intermediate layer. Further, the broken-out section of the substrate was observed by a scanning electron microscope. Exfoliation, roughness on the surface of the piezoelectric film and the formation of cavities in the silicon oxide layer were not found. According to the observation conducted by a scanning electron microscope, the piezoelectric film was composed of uniform spherical crystal grains, and columnar crystal grains were not found at all. The electrostriction constant d31 of the piezoelectric device formed on this substrate was found to be 170 pC/N.

For comparison, a substrate was prepared in the same manner as the above except that the second intermediate layer, i.e., a titanium layer having a thickness of 50 angstroms was not formed. The broken-out section of the substrate was observed by a scanning electron microscope. As a result, it was found that columnar crystal grains were formed on the interface with the lower electrode up to approximately 5,000 angstroms. The electrostriction constant d31 of the piezoelectric device formed on this substrate was found to be 150 pC/N.

What is claimed is:

1. A liquid jet head for ejecting a liquid through a nozzle, comprising:

a single-crystal silicon substrate provided with a liquid chamber for receiving a liquid to be ejected;

a nozzle communicating with the liquid chamber for ejecting the liquid;

a vibratable diaphragm on a surface of the liquid chamber for causing the ejecting of the liquid when vibrated;

a piezoelectric device for vibrating the diaphragm, the device comprising a piezoelectric film which comprises lead, and electrodes on opposite sides of the piezoelectric film, and a tantalum layer comprising tantalum oxide between the diaphragm and one of the electrodes, wherein thicknesses of the piezoelectric film and of the tantalum layer are 1 micrometer or more and 1,100 angstroms or more, respectively.

2. The liquid jet head according to claim 1, wherein the vibrating diaphragm comprises silicon, a silicon compound, zirconia, alumina, and zirconium nitride.

3. The liquid jet head according to claim 1, wherein the tantalum layer is a layer in which a crystal phase of tantalum oxide and that of an oxide represented by the compositional formula $TaPb_YO_X$ are present as a mixture.

4. The liquid jet head according to claim 1, wherein a first intermediate layer is further provided between the one electrode and the tantalum layer, the first intermediate layer comprising titanium oxide, chromium oxided, nickel oxide or tungsten oxide, or an oxide of an alloy of tantalum and a metal of the platinum group or titanium.

5. The liquid jet head according to claim 4, wherein the first intermediate layer has a thickness of 500 angstroms or less.

6. The liquid jet head according to claim 4, wherein the metal of the platinum group is selected from the group consisting of ruthenium, rhodium, palladium, osmium, iridium and platinum.

7. The liquid jet head according to claim 1, wherein a second intermediate layer is further provided between the one electrode and the piezoelectric film, the second intermediate layer comprising titanium oxide, or an oxide of an alloy of titanium and a metal selected from the group consisting of tantalum, nickel and metals of the platinum group.

8. The liquid jet head according to claim 7, wherein the second intermediate layer has a thickness of 200 angstroms or less.

9. The liquid jet head according to claim 7, wherein the piezoelectric film is consisting essentially of spherical uniform crystal grains.

10. A liquid jet head according to claim 1 for use in ink jet printing.

11. A ink jet printer comprising a liquid jet head according to claim 1.

12. A process for producing the liquid jet head according to claim 1, comprising the steps of:

(a) forming a vibratable diaphragm on a first single-crystal silicon substrate;

(b) successively laminating a metallic tantalum layer, a first electrode and a precursor of a piezoelectric film on one side of the diaphragm;

(c) heating the resulting substrate in an oxygen-containing atmosphere substrate in an oxygen-containing atmosphere sufficiently for crystallizing the precursor into the piezoelectric film; and (d) forming a second electrode on the piezoelectric film, wherein thicknesses of the piezoelectric film and of the tantalum layer after the step of heating are 1 micrometer or more an 1100 angstroms or more, respectively and (e) removing the first substrate from underneath at least a portion of the piezoelectric film for forming a space;

(f) joining the first substrate to a second substrate about the space for forming a chamber for a liquid; and (g) communicating both a liquid-ejecting nozzle and a liquid-supplying system with the chamber.

13. A method of preparing a silicon substrate having a piezoelectric device for a liquid jet head that ejects a liquid through a nozzle, the method comprising the steps of:

(a) forming a vibratable diaphragm on a first single-crystal silicon substrate;

(b) successively laminating a metallic tantalum layer, a first electrode and a precursor of a piezoelectric film on one side of the diaphragm;

(c) heating the resulting substrate in an oxygen-containing atmosphere sufficiently for crystallizing the precursor into the piezoelectric film; and (d) forming a second electrode on the piezoelectric film, wherein thicknesses of the piezoelectric film and of the tantalum layer after the step of heating are 1 micrometer or more an 1100 angstroms or more, respectively.

14. The method according to claim 13, wherein a first intermediate layer is formed on the metallic tantalum layer and the first electrode is formed on the first intermediate layer in the step (b), the first intermediate layer comprising titanium oxide, chromium oxide, nickel oxide, tungsten oxide, an oxide of an alloy of tantalum and a metal of the platinum group or titanium, a metal selected from the group consisting of titanium, chromium, nickel and tungsten, or an alloy of tantalum and a metal of the platinum group or titanium.

15. The method according to claim 14, wherein the first intermediate layer has one of a thickness of no more than 500 angstroms when the first intermediate layer comprises titanium oxide, chromium oxide, nickel oxide or tungsten oxide, and a thickness of no more than 200 angstroms when the first intermediate layer comprises a metal selected from the group consisting of titanium, chromium, nickel and tungsten.

16. The method according to claim 13, wherein a second intermediate layer is formed on the first electrode and the precursor of the piezoelectric film is formed on the second intermediate layer in the step (b), the second intermediate layer comprising titanium oxide, or an oxide of an alloy of a metal selected from the group consisting of tantalum, nickel and metals of the platinum group and titanium.

17. The method according to claim 16, wherein the second intermediate layer has a thickness of no more than 200 angstroms.

* * * * *